US006170578B1

(12) United States Patent
Edwards et al.

(10) Patent No.: US 6,170,578 B1
(45) Date of Patent: Jan. 9, 2001

(54) MONOBORE RISER BORE SELECTOR

(75) Inventors: Jeffrey Charles Edwards, Aberdeen; Michael Graham Morgan, Banff, both of (GB)

(73) Assignee: Expro North Sea Limited (GB)

( * ) Notice: Under 35 U.S.C. 154(b), the term of this patent shall be extended for 0 days.

(21) Appl. No.: 09/142,882

(22) PCT Filed: Mar. 27, 1997

(86) PCT No.: PCT/GB97/00862

§ 371 Date: Oct. 13, 1998

§ 102(e) Date: Oct. 13, 1998

(87) PCT Pub. No.: WO97/37101

PCT Pub. Date: Oct. 9, 1997

(30) Foreign Application Priority Data

Mar. 30, 1996 (GB) ..... 9606822

(51) Int. Cl.[7] ..... E21B 34/10

(52) U.S. Cl. ..... 166/339; 166/341; 166/348; 166/359

(58) Field of Search ..... 166/339, 341, 166/344, 348, 368, 359

(56) References Cited

U.S. PATENT DOCUMENTS 5,377,762 * 1/1995 Turner ..... 166/339
5,732,773 * 3/1998 Parks et al. ..... 166/117.5
5,819,852 * 10/1998 Cunningham et al. ..... 166/345
5,941,310 * 8/1999 Cunningham et al. ..... 166/345

* cited by examiner

*Primary Examiner*—William Neuder
(74) *Attorney, Agent, or Firm*—Gifford, Krass, Groh, Sprinkle, Anderson & Citkowski, P.C.

(57) ABSTRACT

A bore selection apparatus (38) is described for facilitating access from a single bore riser to a production bore **(34,34*a*) or annulus bore (36, 36*a*) without using a wireline-run whipstock. The bore selector apparatus disposed within the bore of a BOP stack (12) and which can be coupled between casing or tubing and a sub-sea test tree. The bore selector apparatus (38) can be actuated from the surface or from an ROV to provide a coupling between the tubing bore (44) and the production bore (34, 34*a*) or between the tubing bore (44) and the smaller annulus bore (36, 36*a*). In a preferred embodiment this is achieved by using a rotatable ball valve element (46) located in a housing (42) disposed between the casing/tubing and a sub-sea test tree (39), the ball valve element (46) being apertured and being rotatable between a first position whereby the aperture (48) connects the production tubing to the production tubing bore (34, 34*a*) and in a second position is rotated whereby the aperture (48) connects the annulus bore (36, 36*a*)** to the tubing or casing bore. When one of the production or annulus bores is connected to the tubing bore, then the other bore is isolated or disconnected. Alternative embodiments of the invention are described.

12 Claims, 6 Drawing Sheets

MONOBORE RISER BORE SELECTOR

FIELD OF THE INVENTION

The present invention relates to a system for coupling a monobore high pressure riser, a dual bore sub-sea tubing hanger and a dual bore tubing hanger running tool together. In particular, the invention relates to a monobore riser cross-over apparatus for providing communication between the monobore riser and the dual bores.

DESCRIPTION OF THE RELEVANT PRIOR ART

A conventional sub-sea well system incorporates a dual bore tubing hanger set within a sub-sea wellhead system, with a dual bore sub-sea xmas tree installed onto the wellhead thereby establishing discrete flowpaths for the production, and annulus access bores and communication to downhole safety equipment, the downhole safety valve (DHSV), electrical equipment for measuring pressure and temperature, and other well operating functions in the case of multi-lateral completions.

During the installation procedure wireline plugs are installed through the tubing hanger running tool into the tubing hanger to accommodate the requirements of the statutory authorities, to maintain well control during the interval between the disconnection of the blow-out preventer (BOP) stack from the wellhead and the installation of the xmas tree. Within the production bore a preliminary barrier is established by the installation of a deep-set plug in the downhole completion which is located at or below the packer assembly. A secondary barrier is established by the installation of a second similar plug within a suitable profile in the tubing hanger production bore. On the annulus side, the primary barrier is the downhole packer assembly, and a secondary barrier is established by the installation of a similar wireline set plug in a suitable profile in the annulus access bore within the tubing hanger. Thus, the statutory requirement to provide two barriers between the reservoir and the environment is satisfied.

Once the dual bore xmas tree has been installed onto the wellhead, the wireline plugs are retrieved to facilitate production of the reservoir through the sub-sea xmas tree.

In order to access the two discrete bores of a conventional dual bore production system for the installation of wireline plugs, historical practice has been to utilise a dual bore riser system as shown in FIG. 1 of the drawings. It should be understood that the capital cost of such a conventional dual bore riser system is significant. The most common and economic form of a dual bore riser is the skeletal riser in which two separate tubular members are clamped together at regular intervals to form discrete joints which are usually about 50 ft. in length and which are connected together to form the dual bore riser string. The operational depth limit of such a riser is generally agreed to be about 3000 ft. An alternative to the conventional dual bore skeletal riser system is sought in order to reduce cost, to extend the ability to make available risers in a variety of sizes available a short delivery notice and to extend the opportunities of using sub-sea production systems to exploit oil reservoirs in water depths exceeding 3000 ft. One of these alternatives is already described in applicant's copending International Patent Application PCT/GB96/00435 for a Dual Bore Riser using casing and coiled tubing.

A monobore riser system can be made for less cost and can be made to work in greater water depth much more economically than a dual bore riser system. However, a single bore riser has a significant limitation in that it cannot, on its own, access a dual bore system without there being some means provided to permit an exclusive selection of which of the two bores within the sub-sea tubing hanger to access.

Traditionally, the means by which such an exclusive selection has been accomplished has been to arrange the production bore (A) to be straight and vertical; with the annulus access bore (B) being "kicked off" to one side in the form of an inverted "Y" shape as shown in FIG. 2 of the drawings. Access into the production bore (A) is simply straight down the vertical path and, because the production bore is always larger than the annulus access bore, components which run into the production bore are too large to fit into the annulus bore. Access into the annulus bore is accomplished by blocking the path into the production bore by the installation of a plug, called a whipstock (C), using wireline techniques an example of which is also shown in FIG. 2 of the drawings. The whipstock (C) has a top profile (D) which shaped to encourage components into the annulus access bore (B) to change direction laterally to enter the "Y" branch into the annulus access bore.

One problem of this existing arrangement is that the whipstock has to be run-in on wireline to block the production bore and access the annulus bore. This requires time both to run the tool in and to withdraw the tool which is relatively expensive. In addition, each time there is a wireline operation run, there is a risk of complications.

One proposed solution to overcoming the problems associated with the wireline run whipstock is disclosed in published U.K. Patent Application GB 2258675A to B.P. Exploration Operating Company Limited. This specification discloses a workover system for sub-sea oil and/or gas wells which has a converter to allow the system to be used to access any of the bores of a parallel multiple bore well. A movable bored inner portion can be rotated or swung in pendulum fashion to connect a single bore to one of two parallel bores. In the rotatable embodiment, rotation may be effected using a rack and pinion arrangement and in the pendulum embodiment this may be achieved using hydraulically operated rams or pistons. In both embodiments actuation may be achieved by using electric motors or mechanically by an ROV and they may be controlled from a surface rig or vessel using the hydraulic control system of the workover BOP. However, this prior art reference is intended to couple a single bore to any one of a number of parallel bores in an oil or gas well and in particular one of a number of parallel wells. There is no specific disclosure of the mechanism being used to couple between a single bore and a production or annulus bore and to allow access between the single bore and the production bore and/or the annulus bore.

An object of the present invention is to provide an improved mechanism for facilitating access from a monobore riser to a production bore or annulus bore.

A further object of the present invention is to provide improved access to a production bore or annulus bore in a dual bore system from a monobore riser without using a whip stock run in on a wireline.

SUMMARY OF THE INVENTION

A further object of the present invention is to facilitate communication between a monobore riser and dual bores within a dual bore sub-sea tubing hanger which can be readily controlled from the surface.

This is achieved by providing a bore selector apparatus disposed within the bore of a BOP stack and which can be coupled between casing or tubing and a sub-sea test tree. The bore selector apparatus can be actuated from the surface or from an ROV to provide a coupling exclusively between the tubing bore and the production bore or between the tubing bore and the smaller annulus bore.

In a preferred embodiment this is achieved by using a rotatable ball valve element located in a housing disposed between the casing/tubing and a sub-sea test tree, the ball valve element being apertured and being rotatable between a first position whereby the aperture connects the production tubing to the production tubing bore and in a second position is rotated whereby the aperture connects the annulus bore to the tubing or casing bore. When one of the production or annulus bores is connected to the tubing bore, then the other bore is isolated or disconnected.

In yet another embodiment of the invention the bore selector mechanism is implemented by a flapper plate mechanism which is moveable by a cylindrical sleeve between a first open position whereby access to the production is blocked and there is communication between the casing or tubing and the annulus access bore and a second position whereby a sleeve is actuated to move within the housing forcing the flapper plate to an open position whereby there is communication via the sleeve between the production bore and the casing and the sleeve isolates the annulus access bore from the production bore.

According to a first aspect of the present invention, there is provided bore selection apparatus for use in coupling a monobore high pressure riser with a dual bore sub-sea tubing hanger and a dual bore tubing hanger running tool, said bore selection apparatus comprising:

a housing carrying a bore selection means, said bore selection means being moveable between a first position and a second position, whereby in said first position of said bore selection element, communication is provided between tubing and a main production bore and in said second position, communication is provided between said tubing and said annulus access bore, said bore selection apparatus including means for moving such selection means between said first and said second positions.

Preferably, said selection means is provided by an apertured ball valve element, said apertured ball valve element being moveable between said first and second positions and rotatable as it is moved between said first and second position to provide communication to a respective production bore or annulus access bore, whereby when one of said annulus access bores and production bores is coupled to the main production bore, the other bore is isolated. Conveniently, the apertured ball valve element is arranged to rotate about a horizontal axis through an angle to allow equipment to be run through the monobore into either the production or annulus bores below the ball valve element. The ball valve element is caused to rotate by camming mechanism which comprises an eccentrically mounted pin which is constrained to move vertically and which engages a slot or hole in the rotatable ball element whereby vertical movement of the pin imparts a torque to the rotatable element, thereby causing the ball valve element to rotate.

The bore selector means may be coupled directly to the sub-sea test tree or via a separate coupling sub.

In a further alternative arrangement, the bore selector means is provided by means of a moveable flapper valve which is moveable between a first position where it is arranged to block one of the production and annular access bores and a second out-of-use position whereby it is moved to a position whereby there is communication through either the annulus access bore or the production bore.

Preferably, the bore selector means comprises a housing which carries a pivotably mounted flapper plate, a moveable sleeve is disposed within the production bore and is moveable between a first downstream position and a second upstream position, the sleeve, when in the upstream position, is located such that the flapper valve closes off the production bore and allows communication from the monobore riser only to the annulus access bore, and when the sleeve is actuated to be disposed in said downstream position it urges the flapper valve to an out-of-use position providing communication from the monobore riser through the bore selector mechanism to the production bore only and isolates access to the annulus bore.

Conveniently, the sleeve is actuated hydraulically and this is achieved from surface, using the BOP stack pipework arrangement or via an ROV. Alternatively, the sleeve is actuated mechanically using an ROV.

In yet a further alternative arrangement the bore selector means is provided with a slotted camming mechanism, said camming mechanism having a pair of spaced apart cam plates with slots disposed therein, said flapper plate being pivotably connected to the housing at one end carrying a pin for engagement with said slots, the spaced cam plates being moveable in the longitudinal axis of the housing such that the interaction of the pin and slots causes the flapper plate to move between a first position allowing communication through the production bore and preventing communication through the annulus bore, and a second position allowing communication through the annulus bore and preventing communication through the production bore.

BRIEF DESCRIPTION OF THE DRAWINGS

It will be understood the bore selector means may be actuated from surface or via an ROV using hydraulic, mechanical or electrical means.

These and other aspects of the present invention will become apparent from the following description when taken in combination with the accompanying drawings in which.

DETAILED DESCRIPTION OF PREFERRED EMBODIMENTS

Figure 3:
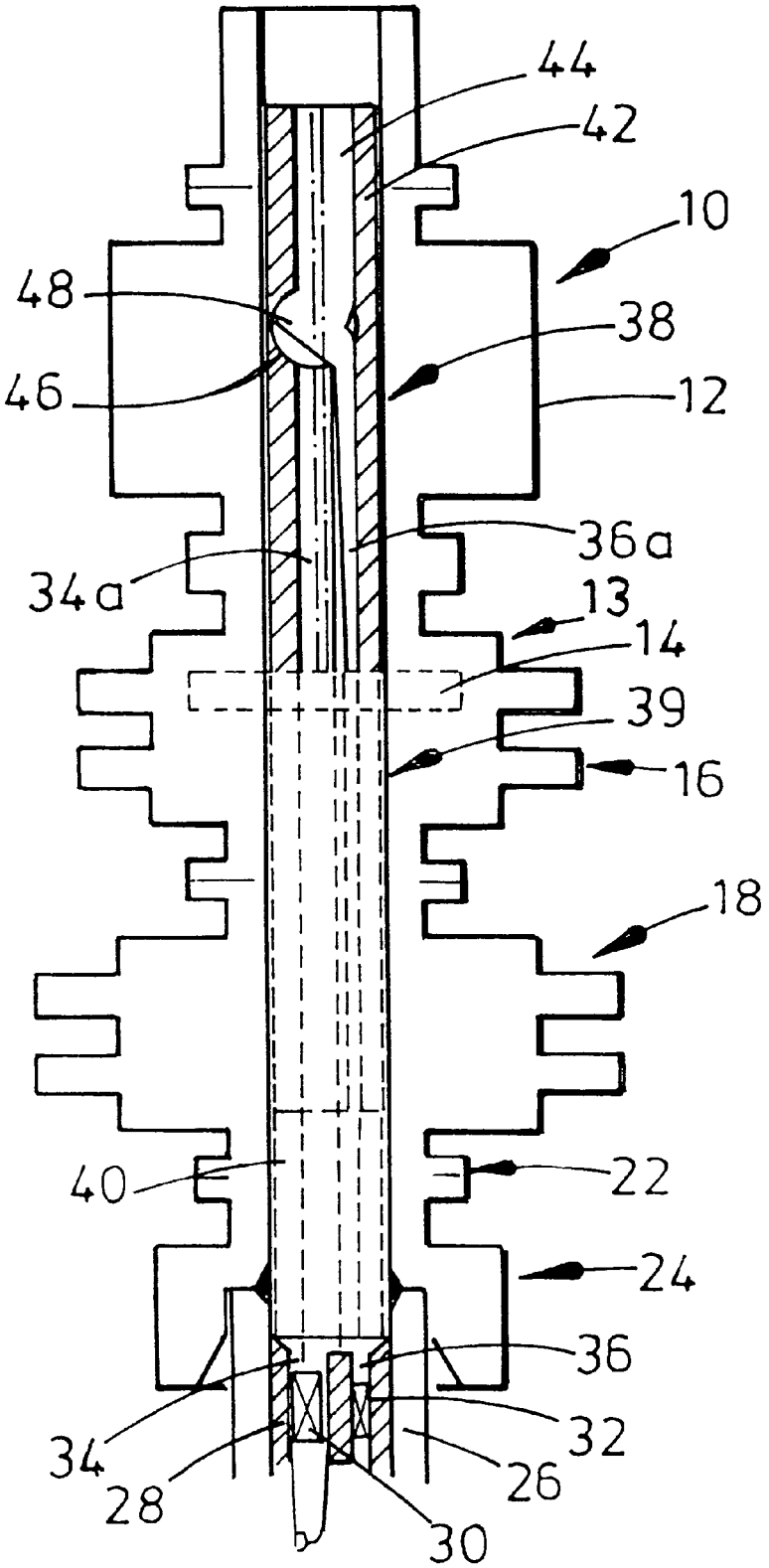
FIG. 3 is a schematic view of a wellhead arrangement similar to that shown in FIG. 2 but incorporating a bore selector apparatus in accordance with a first embodiment of the present invention.

Reference is first made to FIG. 3 of the drawings which depicts a sub-sea wellhead assembly, generally indicated by reference numeral 10, consists of an annular BOP 12 coupled to a shear ram housing 13 containing BOP shear rams 14 (shown in broken outline) and two pairs of BOP rams 16 and 18 disposed beneath the shear rams 14. The housing 13 of the shear rams 14 is coupled via flange 22 to a BOP connector 24 which connects to the sub-sea wellhead 26.

Figure 1:
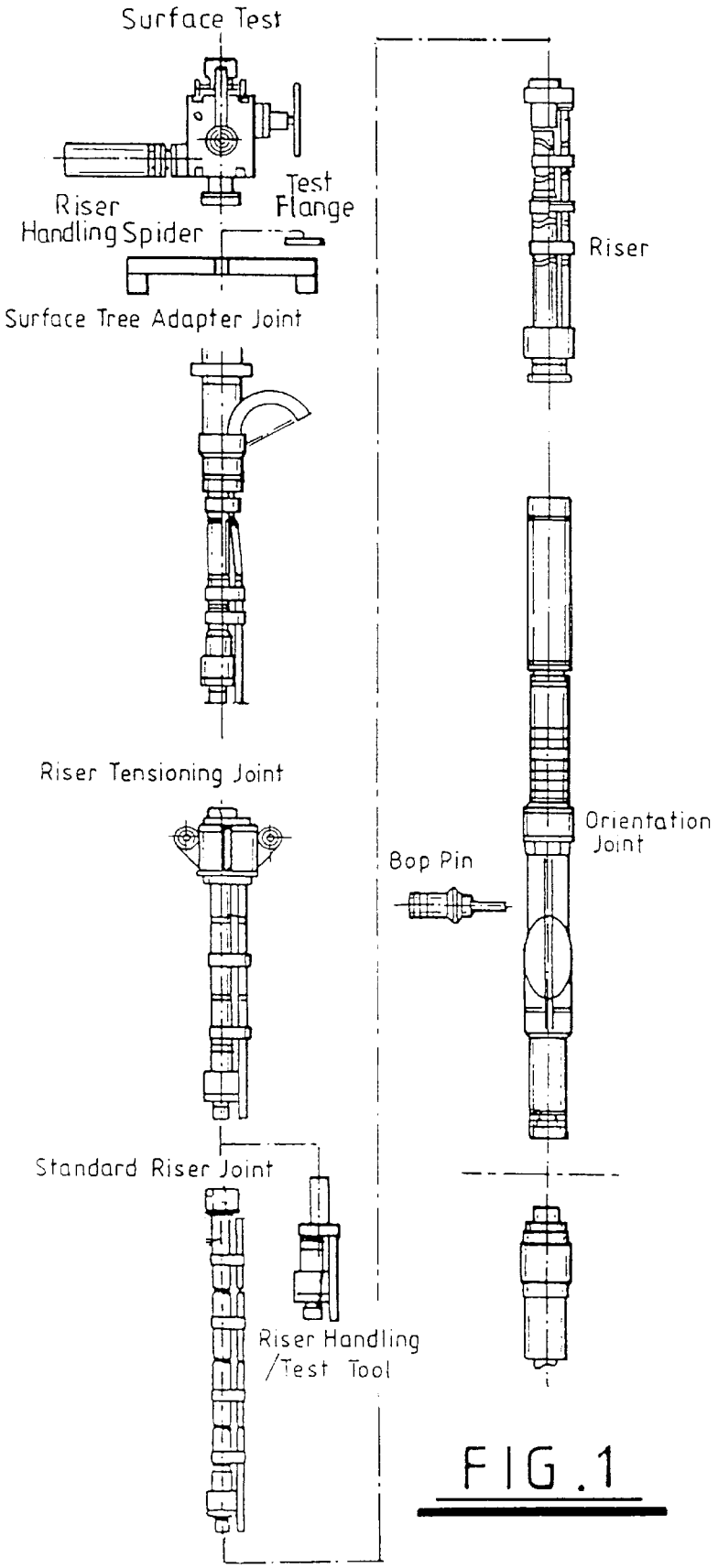
FIG. 1 is a schematic and exploded view of a dual bore riser system which is typical of a prior art arrangement.
Figure 2:
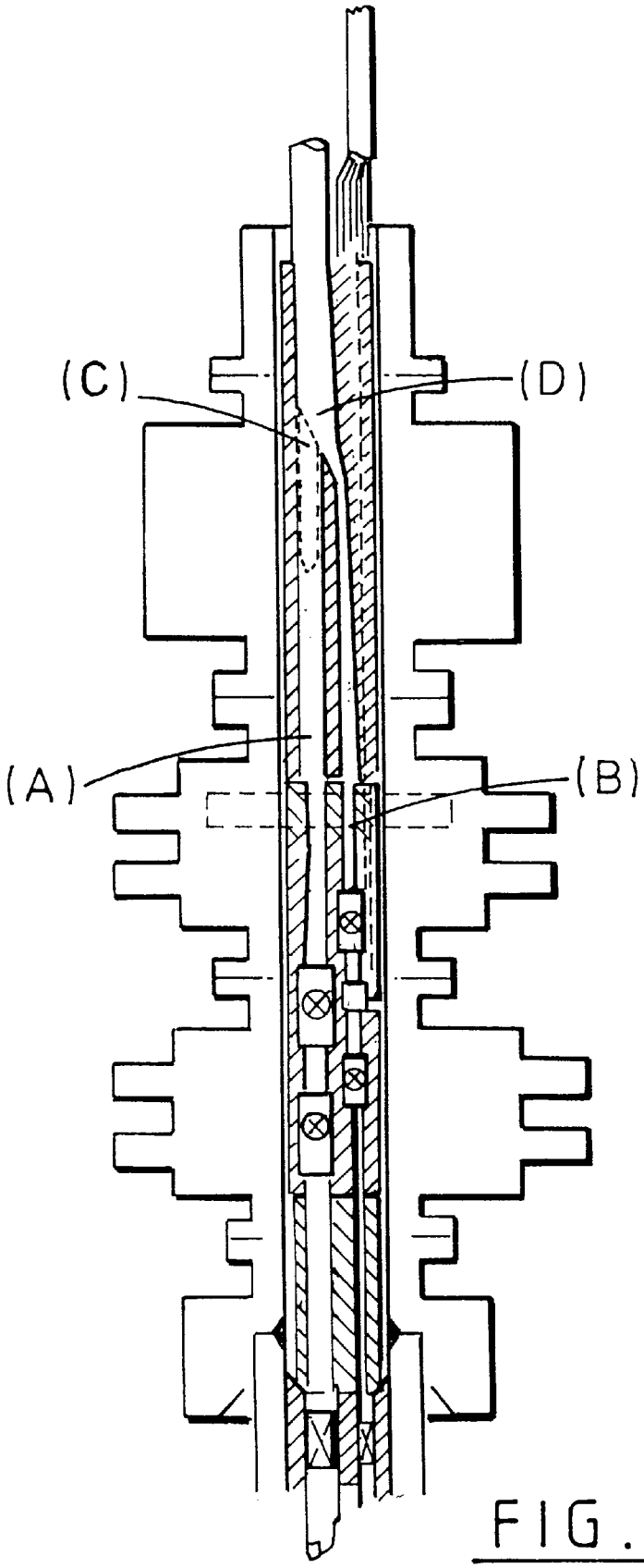
FIG. 2 is a diagrammatic view through a sub-sea wellhead assembly showing a prior arrangement for selecting an annulus bore instead of a production bore using a whipstock run in on wireline.

Within the wellhead 26 is located a proprietary 7"×2" tubing hanger 28 with two wireline plugs 30 and 32 shown installed in the production bore 34 and the annulus bore 36 respectively. It will be appreciated that the production and annulus bores 34,36 are coupled to similar bores 34*a*,36*a* in the bore selector apparatus, generally indicated by reference numeral 38, via a 7"×2" sub-sea test tree 39 of the same type as shown in FIG. 2 of the drawings and as disclosed in applicant's co-pending U.K. Patent Application No. 9509547.7 and via a proprietary 7"× 2" tubing hanger running tool (THRT) 40 (shown in broken outline).

The bore selector apparatus 38, has an outer housing 42 defining a top bore 44. Disposed within the housing 42 is a rotatable ball-like valve element, generally indicated by reference numeral 46. Beneath the rotatable element 46 is disposed the main bore 34*a* and the smaller diameter bore 36*a*. These bores register with the production and annulus bores in the 7"×2" sub-sea test tree as seen in FIG. 3. It will be seen that the bores 34*a* and 36*a* are separated by a barrier 50 which terminates just beneath the ball valve element creating, in the view shown, a hollow profile within the apparatus 38 which is shaped like the inverted "Y". This "Y" profile (44,34*a*,36*a*) incorporates the rotatable element 46 to select either the branch bores. It will be appreciated that the rotatable element 46 is made to rotate about a horizontal axis through an angle to suit the ability to let equipment run through the monobore 44 into either of the production or annulus bores 34*a*,36*b* below the rotary element 46. The rotatable element can be implemented by an apertured ball valve as described above in which the element 46 is caused to rotate by a camming mechanism as disclosed in applicant's co-pending application published as WO93/03255 comprising an eccentrically mounted pin which is constrained to move vertically and which engages a slot or hole in the rotatable element 46 so that the vertical movement of the pin imparts a torque to the rotatable element 46, thus causing the element to rotate. The element 46 has a through-aperture, generally indicated by reference numeral 48, and the element 46 is rotatable within the housing 42 so that the aperture can be rotated to align only with the main bore 36*a* or with the secondary annulus access bore 36*a* as shown in FIG. 3 of the drawings, thus providing a selection from the main riser bore to either the production bore 34 or to the annulus bore 36. Rotation of the ball valve element is effected from the surface as disclosed in WO 93/03255, the disclosure of which is incorporated herein.

It will also be understood that other apparatus may be provided in which relative vertical movement between an eccentric and a rotatable element or a cage containing and restraining a rotating element causes rotation of a rotary element.

In the case of intervention with the tubing hanger 28, the location of the "Y" branch (44,34*a*,36*a*) and the bore selector apparatus 38 is above the dual bore sub-sea test tree 39 which provides suitable barriers in the production and annulus access bores 34,36. The "Y" branch and the bore selector 38 may also be accommodated within the tubing hanger orientation joint (not shown).

In the case of intervention with a sub-sea xmas tree, the "Y" branch (44,34*a*,36*a*) and the bore selector apparatus 38 are accommodated within the lower end of the riser system. This allows the employment of existing dual bore lower riser package safety blocks (LRP) and/or emergency disconnect packages (EDP) of the workover riser system. It will also be understood that the bore selector apparatus may be incorporated into a monobore system, located below the safety valves in the LRP/EDP, so that the selection of the bore occurs immediately above the sub-sea xmas tree.

Figure 4:
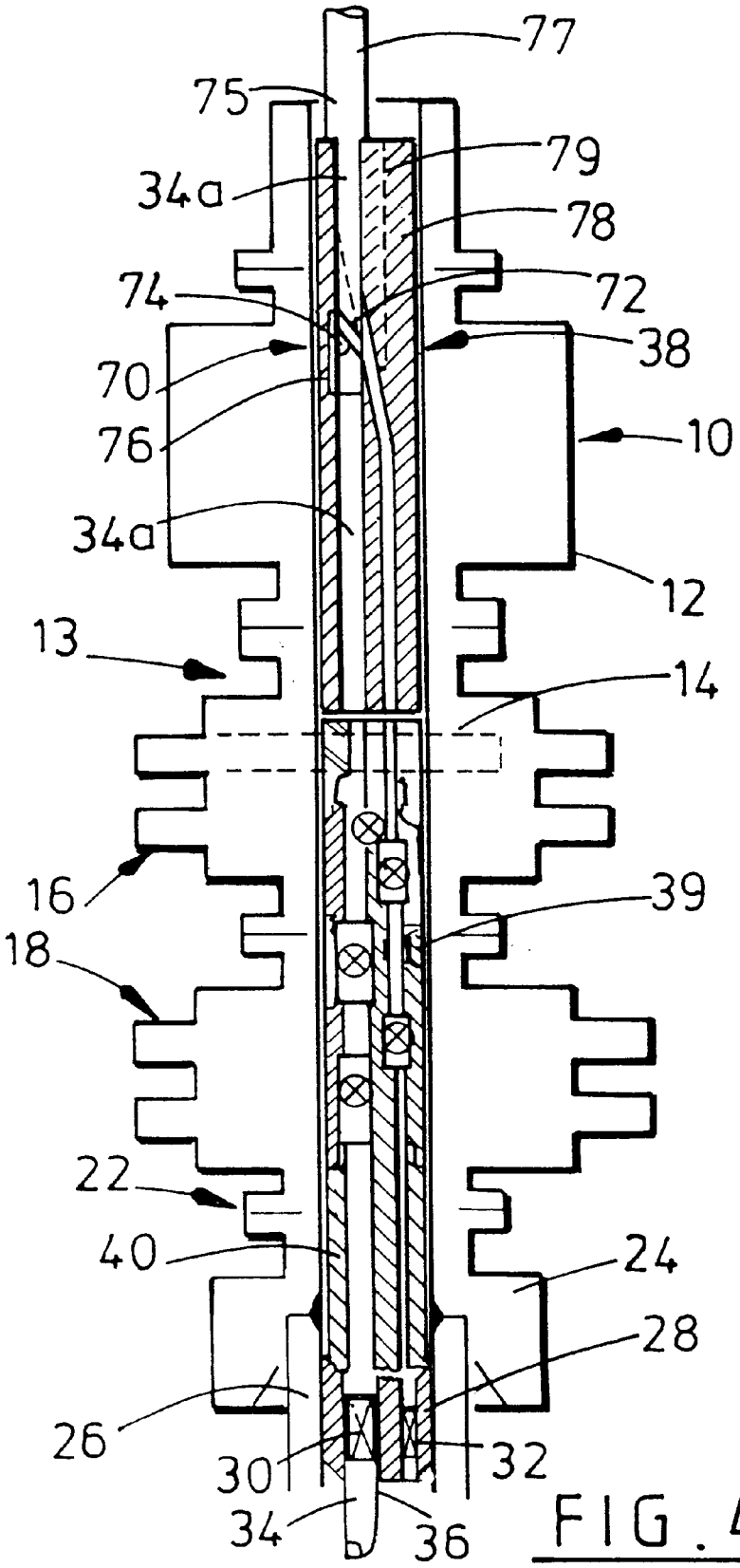
FIG. 4 depicts a schematic view similar to that shown in FIG. 3 and shows an intervention system and a second embodiment of a bore selector apparatus in accordance with the present invention.

Reference is now made to FIG. 4 of the drawings which depicts a further embodiment of a bore selector apparatus in accordance with the present invention with like numerals also referring to like parts in FIG. 3. In this case, the bore selector apparatus, generally indicated by reference numeral 70, includes a hinged oval flapper plate 72 located at a downward facing angle 74 within the production bore 34*a*. The plate 72 is rotatable between an open and a shut position by the axial travel of a tubular sleeve 76 located below the oval plate 72. The bore selector apparatus 70 has a production bore 34*a* coupled to the bore 75 of 7" casing 77 and annulus bore 34*a* is coupled to the top of the housing 78 by a control line 79 (shown in broken outline) to allow annulus monitoring.

Figure 5A:
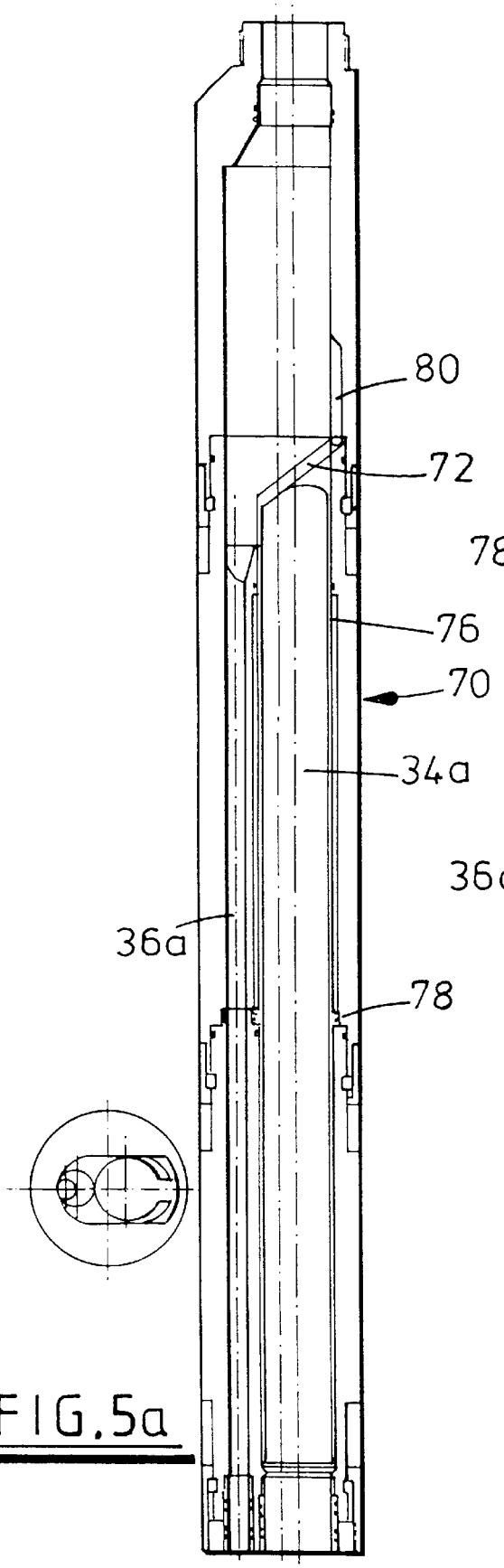
FIGS. 5*a* and 5*b* depict enlarged and more detailed drawings of the embodiment shown in FIG. 4 with the flapper valve in an open and a closed position respectively.
Figure 5B:
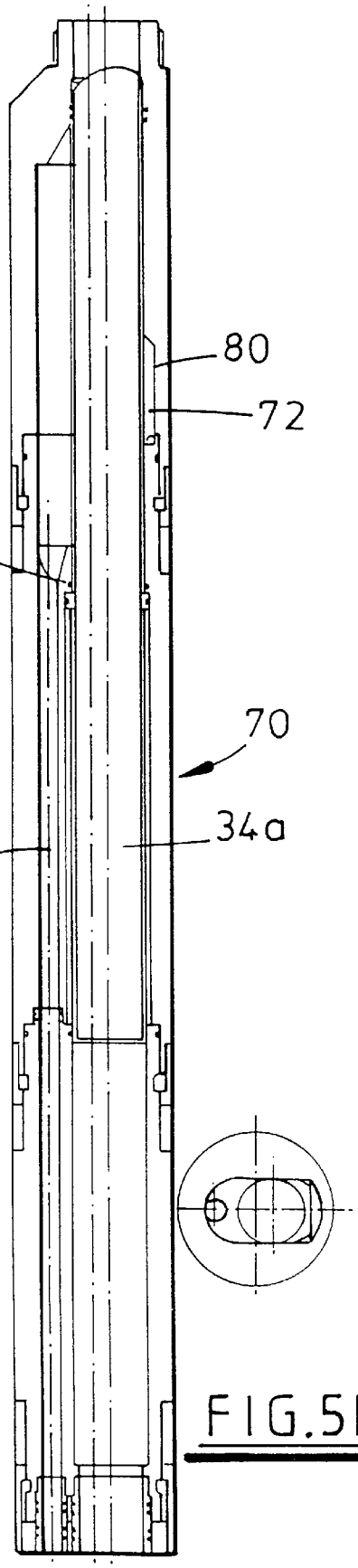

Reference is now made to FIGS. 5*a* and 5*b* of the drawings where it will be seen that the sleeve 76 includes an annular piston 78 which is moveable in the vertical plane by the application of pressurised hydraulic fluid to actuating cylinders (not shown) disposed at each side of the piston. From FIG. 5*a* it will be seen that when the sleeve 76 is in the lower position the flapper plate 72 is also in the lower position closing the production bore 34*a* and providing communication with the annulus access bore 36*a*. When the sleeve is moved in the upper position as shown in FIG. 5*b* the flapper plate 72 is in an upright position located in a recess 80 whereby access to the production bore 34*a* is open, through the sleeve and, simultaneously, the sleeve 76 extends within the housing 70 to the top and, as can be seen, isolates access to the smaller annulus axis bore 36*a*. The area on the underside of the sleeve 76 exposed to wellbore pressure is made deliberately larger than a similar area on the upper side of the sleeve so that, in the event of a failure of the hydraulic system, the resultant force on the sleeve is upward to ensure that the sleeve takes the position in the upper location shown in FIG. 5*b* which provides access to the production bore.

Reference is now made to FIGS. 6*a*, 6*b* and 7*a* and 7*b* of the drawings which depict longitudinal sectional and cross-sectional views through a bore selector apparatus 82 in accordance with a further embodiment of the present invention. In this case, the bore selector apparatus 82 can be set to allow access to a 2" annulus bore or a 6" production bore from a single bore 44 as will now be described.

Figure 6B:
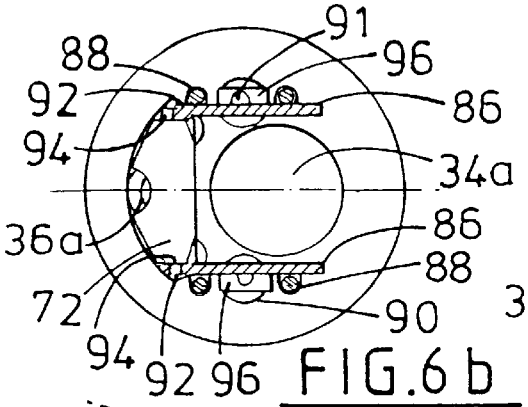
FIGS. 6*a* and 6*b* are longitudinal sectional and cross-sectional views through a bore selector apparatus in accordance with an alternative embodiment of the invention with a flapper-plate arranged to provide access to a 6" production bore.
Figure 6A:
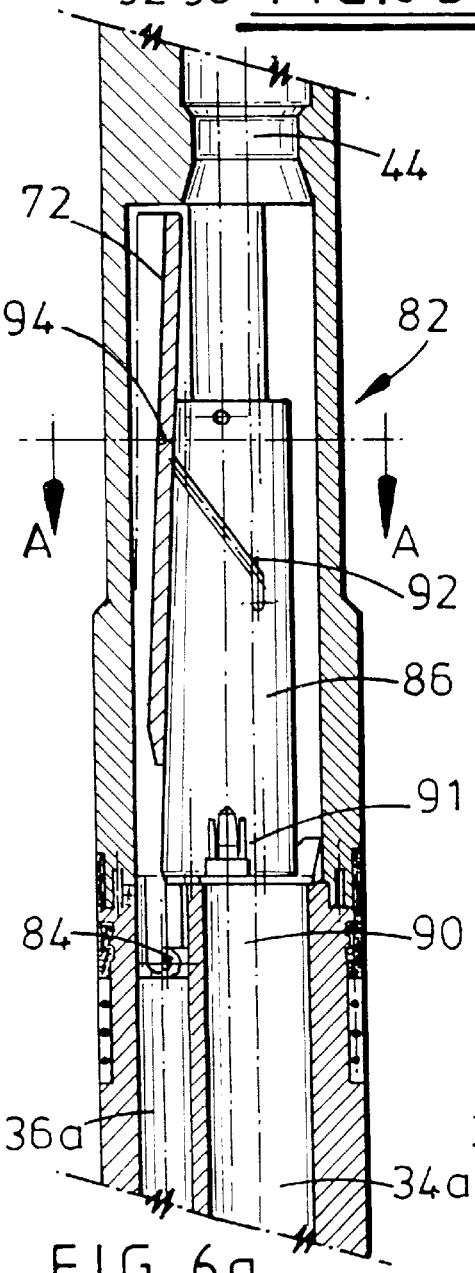

Reference is first made to FIGS. 6*a* and 6*b* which depicts the bore selector set for providing access to the 6" production bore 34*a*. In this embodiment like numerals will refer to like parts.

Figure 7B:
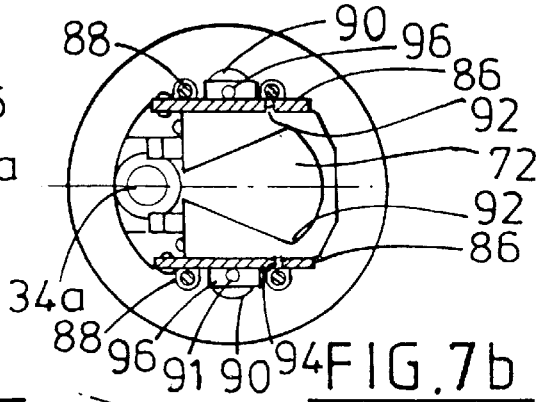
FIGS. 7*a* and 7*b* are view similar to FIGS. 6*a* and 6*b* with the flapper plate arranged to provide access to a 2" annulus bore.
Figure 7A:
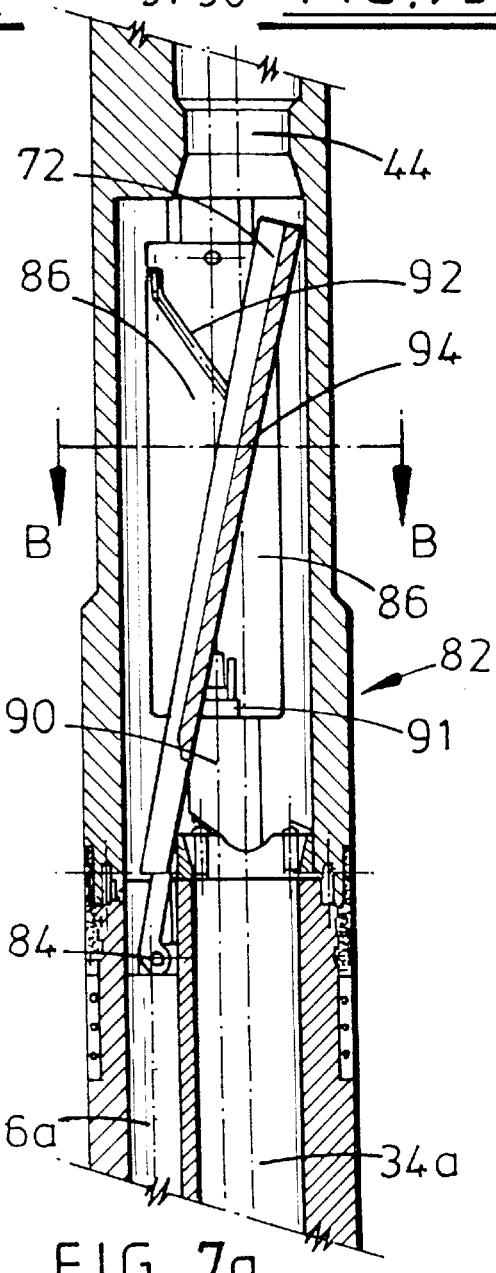

With regard to FIGS. 6*a* and 6*b* it will be seen that the flapper plate 72 is pivotally mounted at one end 80 for pivotal movement between a substantially upright position as shown in FIG. 6*a* where access to the production bore 34*a* is allowed and an inclined position, as best seen in FIGS. 7*a* and 7*b*, where the flapper plate restricts access through bore 34*a* and allows access to annulus bore 36*a*.

Still referring to FIGS. 6*a* and 6*b*, it will be seen that a pair of cam plates 86 constrained by connections to vertical rods 86 (FIG. 6*b*) are moveable along the longitudinal access of the bore selector apparatus 82 (which typically coincides with the vertical plane) by the application of pressurised hydraulic fluid to a pair of actuating cylinders 90 which are disposed at each side of the cam plates as best seen in FIG. 6*b*.

A cam slot 92 is provided in each cam plate 86 and a cam pin 94 is provided at each side of the flapper plate 72 and engages with the cam slot 92 in each cam plate 86. Thus, when the cylinders 90 are actuated to cause axial travel of the cam plates, this results in an interaction between the cam slots 92 and cam pins 94 which cause a change in the inclination of the flapper plate 72. The pistons 91 of the actuating cylinders 90 are connected to the cam plates 80 by end blocks 96 (FIG. 6*b*, FIG. 7*b*.

As shown in FIGS. 6*a* and 6*b* the pistons 91 remain in a lower position, such that the flapper plate 72 is substantially vertical, closing the annulus bore 36*a* and allowing access to the production bore 34*a*. When the pistons 91 are actuated to move the cam plates 86 upwards, as shown in FIG. 7*a*, the engagement of the cam pin 94 with the cam slots 92 causes the flapper plate 72 to move across the interior of the bore selector apparatus 82 to lie in the inclined position shown in FIG. 7*b* so that it allows access to the 2" annulus bore 36*a* and, simultaneously, prevents access to the 6" production bore 34*a*. Reactuation of the cylinders 90 to move downwards will return the flapper plate to the position shown in FIGS. 6*a*,6*b*.

It will be appreciated that various modifications may be made to the embodiments hereinbefore described without departing from the scope of the invention.

For example, it will be appreciated that any of the embodiments hereinabove described may be used with an annulus bore and a production bore of different sizes. With regard to the embodiment shown in FIGS. 6*a*,6*b*,7*a* and 7*b*, it will be understood that an annular piston can replace the dual hydraulic actuating means. In addition, an annular piston (cylinder) may replace the cam plates, with a groove or slot machined in the inner surface of the piston, for receiving pins from the flapper plate so that, as the annular piston is actuated to rise and fall, the flapper plate moves between positions as shown in FIGS. 6*a*,6*b* and in FIGS. 7*a*,7*b*.

Advantages of the invention include; the bore selection apparatus provides improved access from a monobore riser to either a production bore or annulus bore without the need for a whipstock, the operation of bore selection apparatus can be controlled from surface and the bore selection apparatus can be used in combination with a dual bore sub-sea test tree to provide a well controlled system satisfying statutory requirements.

What is claimed is:

1. Bore selection apparatus for use in coupling a monobore riser to a dual bore sub-sea tubing hanger and a dual bore tubing hanger running tool, said bore selection apparatus comprising:

a housing carrying an apertured ball valve, said apertured ball valve being moveable between a first position and a second position and rotatable as it is moved between said first and second positions, whereby in said first position of said apertured ball valve, communication is provided between tubing and a main production bore and in said second position, communication is provided between said tubing and an annulus access bore, said bore selection apparatus including means for moving said bore selection means between said first and said second positions, whereby when one of said annulus access bore and said production bore is coupled to the main production bore, the other bore is isolated.

2. Apparatus as claimed in claim 1 wherein the apertured ball valve element is arranged to rotate about a horizontal axis through an angle to allow equipment to be run through the monobore into one of the production bore and the annulus bore below the ball valve element.

3. Apparatus as claimed in claim 2 wherein the ball valve element is caused to rotate by a camming mechanism which comprises an eccentrically mounted pin which is constrained to move vertically and which engages an aperture in the ball valve element whereby vertical movement of the pin imparts a torque to the ball valve element, thereby causing the ball valve element to rotate.

4. Bore selection apparatus as claimed in claim 1 in combination with a dual bore sub-sea test tree.

5. Bore selection apparatus as claimed in claim 1 in combination with a single bore riser.

6. Bore selection apparatus for use in coupling a monobore riser to a dual bore sub-sea tubing hanger and a dual bore tubing hanger running tool, said bore selection apparatus comprising:

a housing carrying a moveable flapper valve which is moveable between a first position where it is arranged to block one of the production and annular access bores and a second out-of-use position whereby it is moved to a position whereby there is communication with one of the annulus access bore and the production bore, said moveable flapper valve including means for moving said flapper valve between said first and said second positions.

7. Apparatus as claimed in claim 6 wherein the bore selection means comprises a housing which carries a pivotably mounted flapper plate, a moveable sleeve is disposed within the production bore and is moveable between a first downstream position and a second upstream position, the sleeve, when in the upstream position, is located such that the flapper valve is in the first position and closes off the production bore and allows communication from the monobore riser only to the annulus access bore, and when the sleeve is actuated to be disposed in said downstream position it urges the flapper valve to an out-of-use position providing communication from the monobore riser through the bore selector mechanism to the production bore only and isolates access to the annulus bore.

8. Apparatus as claimed in claim 7 wherein the sleeve is actuated hydraulically and this is achieved from surface using the BOP stack pipework arrangement or via an ROV.

9. Apparatus as claimed in claim 7 wherein the sleeve is actuated mechanically using an ROV.

10. Apparatus as claimed in claim 6 wherein the bore selector means is provided with a slotted camming mechanism, said camming mechanism having a pair of spaced apart cam plates with slots disposed therein, said flapper plate being pivotably connected to the housing at one end carrying a pin for engagement with said slots, the spaced cam plates being moveable in the longitudinal axis of the housing such that the interaction of the pin and slots causes the flapper plate to move between a first position allowing communication through the production bore and preventing communication through the annulus bore, and a second position allowing communication through the annulus bore and preventing communication through the production bore.

11. Bore selection apparatus as claimed in claim 6 in combination with a dual bore sub-sea test tree.

12. Bore selection apparatus as claimed in claim 6 in combination with a single bore riser.

* * * * *